United States Patent [19]

DeLong

[11] 3,960,405

[45] June 1, 1976

[54] BENCH SEAT WITH END ALIGNING AND REINFORCING INSERT

[76] Inventor: David C. DeLong, 1221 Broad St., Grinnell, Iowa 50112

[22] Filed: Oct. 31, 1974

[21] Appl. No.: 519,601

Related U.S. Application Data

[63] Continuation of Ser. No. 326,600, Jan. 26, 1973, abandoned.

[52] U.S. Cl. ..... 297/248; 52/8; 108/64; 297/249

[51] Int. Cl.[2] ..... A47C 11/00

[58] Field of Search ..... 297/248, 249; 52/8, 52/9; 248/235; 182/222, 223; 108/114, 64

[56] References Cited

UNITED STATES PATENTS

| | | | |
|---|---|---|---|
| 2,985,924 | 5/1961 | Burke | 52/8 |
| 3,482,874 | 12/1969 | Henebry | 297/248 X |
| 3,554,142 | 1/1971 | Sorenson | 248/235 |
| 3,584,916 | 6/1971 | Bayes | 297/249 X |
| 3,657,854 | 4/1972 | Tipton | 52/8 |

FOREIGN PATENTS OR APPLICATIONS

| | | | |
|---|---|---|---|
| 656,901 | 9/1951 | United Kingdom | 182/223 |
| 536,347 | 5/1941 | United Kingdom | 182/222 |

*Primary Examiner*—Francis K. Zugel
*Attorney, Agent, or Firm*—Warren H. Kintzinger

[57] ABSTRACT

An alignment structure for end to end positioned multichanneled seats and footboards such as may be used for seating stadium stands. Channel shaped inserts positioned in laterally spaced front and rear channels of two end to end seat sections (or footboards) span the joint between the seat sections and extend end wise into each to maintain end to end alignment between the seat sections. Each channel shaped insert is anchored in one or the other of the end to end seat sections and permits expansion and contraction displacement movement between the seat sections.

5 Claims, 5 Drawing Figures

BENCH SEAT WITH END ALIGNING AND REINFORCING INSERT

Figure 1:
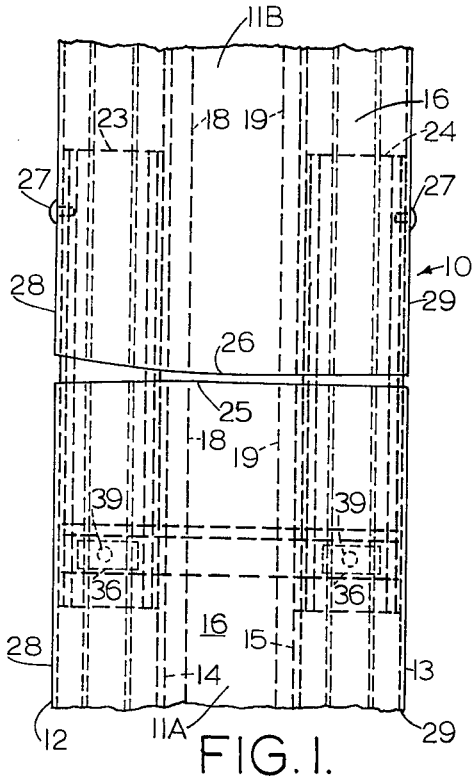

This is a continuation of application Ser. No. 326,600, filed Jan. 26, 1973, now abandoned.

This invention relates in general to stadium type seating section to section endwise alignment and, in particular, to a front and rear channel insert alignment system for end to end positioned seat sections.

It is important that end to end positioned elongate channeled stadium seats and footboards be joined together with a relatively smooth joint and remain in line year after year. Alignment should be maintained through seams in continuous row lengths and expansion joints provided to insure alignment throughout expansion and contraction cycles with heating and cooling. Misalignment at a seam has been a constant problem with pre-existing inadequate methods of securing two end to end positioned seat sections together over a seat support with a seam plate. This not only adds expense by bolts required to bolt it together and to the seat support but also raises up the seat by the gauge thickness of the adapter seam plate to add to the misalignment problem. Further, when a seam plate is used other than over a seat support but in the middle of a span between two seat supports strength through the seam joint may be inadequate, marginal at best, and the alignment problem may still exist. When a customer calls for immediate delivery of aluminum plank for stadium seats in a length not stocked the option heretofore was to either cut down longer lengths producing undesired scrap or ordering the exact piece count and cutting lengths from an extrusion producer, a procurement procedure that generally takes a minimum of six weeks before shipment is made. Continuity in row length where seating row lengths are curved to conform to the concrete curve at the risers is desirable, however, there have been problems with miters used and excessive labor costs. Sharp edges at a joint seam of some seating plank units come into contact with either clothes or skin and can easily cut or tear material or skin. This is a hazard with misalignment at seams, particularly with the seam plate method of securing two seat planks together over a seat support, and with plank ends separating either fore or aft. When butting two aluminum seating planks together the seam will be a perfect seam only if the plank extrusion supplier gives a perfect 90° cut on mating ends, a condition many times not achieved. End capping of seating plank ends and leaving, for example, a half inch gap spacing is one method that has been used with adjacent seating plank ends, obviously an expensive solution that still does not attain desired alignment and structural integrity.

It is, therefore, a principal object of this invention to attain improved alignment between end to end positioned multi-channeled seat and footboard extrusions.

Another object is to provide a safer and stronger stadium seat structure.

A further object is to cut material and labor costs in providing such improved seats.

Another object is more efficient use of stocked seating extrusions with minimized scrap.

Still another object is to achieve more prompt service on custom fabrication jobs through use of applicant's improved front and rear channel insert alignment system for end to end positioned seat sections.

Another object is to eliminate any requirements for miters with curved seat sections.

A further object is for seam gaps between end to end positioned seating extrusions to be bridged at the front and rear laterally spaced portions by dual channel inserts.

Still another object is an ease of assembly with smaller channel inserts being more readily inserted into front and rear spaced channels in end to end positioned seating extrusions than would be the case with a single big channel insert being crammed into and spanning end to end seating planks.

A further object is to limit any requirement for end caps solely to seating row ends.

Features of this invention useful in accomplishing the above objects include, in a front and rear channel insert alignment system for end to end positioned multi-channeled seating extrusions, seat extrusions with spaced parallel laterally spaced front and rear generally U shaped channels. Relatively stiff elongate strong insert channel elements usually of the same material as the seat extrusions, sized, respectively, to fit the front and rear U shaped channels of the seat extrusions, are inserted into the appropriate channels of two end to end positioned seat extrusions to bridge any gap at the end to end seam therebetween and structurally maintain good alignment between the seat extrusions. There is adequate overlap insertion into each respective seat extrusion channel to insure structural integrity, and each of the inserts is fixed in longitudinal position in one or the other of the end to end seat extrusions by a rivet or bolt extended through a channel wall of a seat extrusion and through a wall of the insert so that the expansion and contraction movement in the structure is accomodated with endwise slippage of the insert in at least one of two aligned seat extrusion channels.

Specific embodiments respresenting what are presently regarded as the best modes of carrying out the invention are illustrated in the accompanying drawing.

Figure 5:
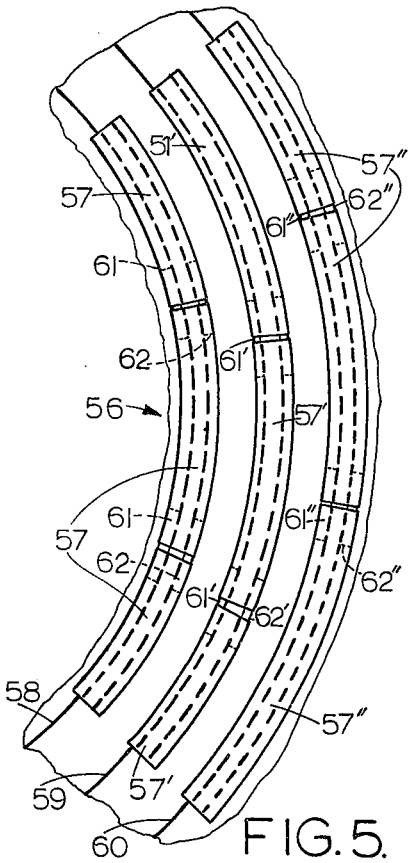
Figure 2:
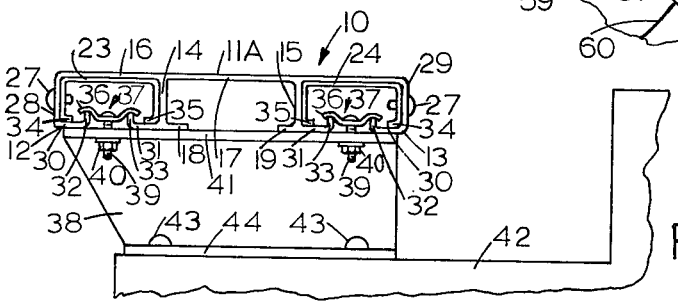
Figure 3:
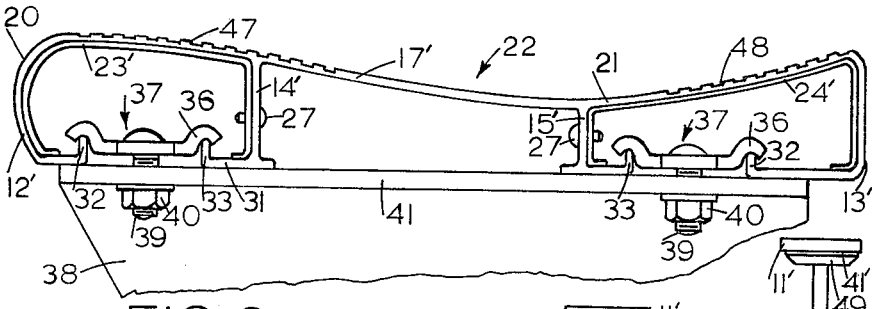
Figure 4:
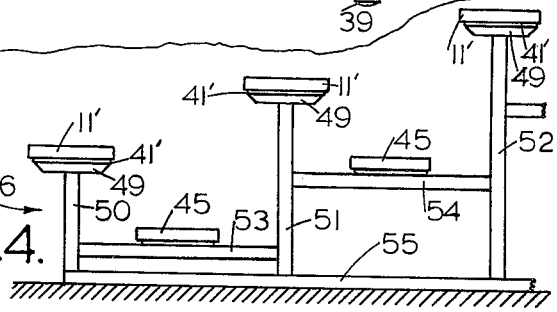

In the drawing:

FIG. 1 represents a partial top plan view of two end to end positioned seating plank extrusions having spaced front and rear channels and a front insert and a rear insert in the channels and spanning the extrusion plank end to end seam;

FIG. 2, a partial side elevation of the seating plank extrusion assembly of FIG. 1 mounted on a concrete step section of a stadium;

FIG. 3, a partial side elevation of an anatomic contour seating plank embodiment used in place of the seating plank extrusions of FIGS. 1 and 2;

FIG. 4, a partial side elevation of a bleacher using seating planks such as those of FIGS. 1 and 2 that are also used as footboards; and FIG. 5, a partial top plan view of a curved stadium seat section using seating planks such as those of FIGS. 1 and 2 in curved form to match the curve of the stadium sections they are used in.

Referring to the drawing:

The seating plank extrusion assembly 10 of FIGS. 1 and 2 is shown to include two extruded seating planks 11A and 11B formed with spaced parallel front and rear underside channels 12 and 13. The inner walls 14 and 15 of channels 12 and 13 and the center section of the upper surface portion 16 of plank extrusions 11A and 11B form a center channel 17 open toward the bottom with longitudinal bottom lips 18 and 19. Front and rear underside channels 12 and 13 are essentially duplicates one of the other with the embodiment of FIGS. 1 and 2 while they may be individually shaped spaced front and rear underside channels 20 and 21 as with the seating plank 22 embodiment of FIG. 3. In any event front and rear channel inserts 23 and 24 that are U shaped channel elements are positioned in channels 12 and 13. The inserts 23 and 24, sized to be snug sliding fits within the channels 12 and 13, are positioned to span the seam between ends 25 and 26 of end to end positioned seating planks 11A and 11B and extend sufficiently far into both to maintain excellent alignment therebetween and give structural strength through the joint. Rivets 27 (or bolt structures) are inserted, respectively, through front and rear outer walls 28 and 29, of one or the other of the end-to-end seating planks, such that each insert is secured by a rivet 27 in but one of the two seating plank channels into which it is received and the respective adjacent walls of the inserts 23 and 24.

Each of the front and rear underside channels 12 and 13 have bottom outer and inner lips or webs 30 and 31 with upturned edge extensions 32 and 33 spaced inwardly from the lips 34 and 35 of front and rear channel inserts 23 and 24. Clips 36, shaped to fit over the tops of the edge extensions 32 and 33 and span the space therebetween, are used as part of bolt-clip assemblies 37 used for securing seating planks 11A and 11B in place on seat supports 38. Bolts 39 of bolt-clip assemblies 37 extend to nuts 40 through the clips 36 and top flange 41 of seat supports 38 that are in turn mounted in place on a base 42 by mounting pins, bolts or rivets 43 extended through bottom flange 44 of seat supports 38. This is with base 42 a step molded concrete structure such as used in stadiums. It is of interest to note that bolt-clip assemblies 37 may be used with a seat support 38 substantially anywhere longitudinally along the end to end positioned seating plank 11A and 11B assembly with inserts 23 and 24 in the area of the inserts or not as desired without the inserts presenting any problems to such mounting. Bolt-clip assemblies 37 may even be used at, for example, the seam at seating plank ends 25 and 26 which are shown with an exaggerated irregular gap in FIG. 1 for illustrative purposes. The channel inserts 23 and 24 are positioned very advantageously for the purpose intended giving desired alignment and structural support at the front and back channels of multi-channeled seating planks 11A and 11B. Further, the channel inserts 23 and 24 substantially fill the gap between plank ends 25 and 26 at the front and rear of the end to end seating planks to minimize catching and tearing of clothing and skin by sharp metal edges at what would otherwise be open cracks. Seating planks 11A and 11B now being supplied are extruded aluminum planks anodized when used as seats 11' and generally non-anodized when used as footboards 45 in the bleacher unit 46 of FIG. 4. Channel inserts 23 and 24 are much more easily fitted and assembled in place spanning seating plank ends than would be the case with a single large channel insert spanning the full width of seating planks from front to rear. Further, such full width seating plank inserts besides being quite awkward to handle and insert would require use of seating planks without internal reinforcing ribs defining a plurality of channels as with the seating planks shown.

The channel inserts 23 and 24 as used in the assembly of FIGS. 1 and 2 advantageously facilitates use of random seating plank lengths and reduces scrap to an absolute minimum. The system of channel inserts permits more prompt service on custom field jobs since the requirements can be filled with any lengths and most cutting sections can be utilized instead of scrapped. Obviously, this leads to optimization of inventory with more stocking of standard length planks and resultant savings to both the supplier and to the customer. The insert seat plank assembly does not require that joints occur at seat supports with the inserts securing and maintaining alignment without requiring critical adjustments and with the inserts extended through joints acting as expansion joints for seat plank expansion and contraction with temperature variation. The insert assembly not only compensates for imperfectly cut seating plank ends (perfect 90° cuts are not always attained on stock seating planks) but also provides a neater assembled stadium seat appearance.

Seating plank extrusions with multi-channels open to the bottom can assume any number of configurations other than the straight planks 11A and 11B of FIGS. 1 and 2. The anatomic contour seat plank extrusion 22 of FIG. 3 is only one example of these additional embodiments. With the seating plank extrusion 22 the front and rear underside channels 12' and 13' separated by center channel 17' are of materially different shapes rather than being of substantially the same cross-section as with channels 12 and 13 of FIG. 2 and as a result the front and rear channel inserts 23' and 24' are individually shaped to be snug sliding fits within channels 12' and 13'. Portions of this embodiment substantially the same as with that of FIGS. 1 and 2 are numbered the same and some that are somewhat different are given primed numbers, and a complete explanation thereof is not repeated again as a matter of convenience. The extruded seating plank extrusion 22 is provided with external top surface fluted sections 47 and 48. The positioning of sleeve anchoring rivets 27 extending through internal channel walls and channel inserts internal walls illustrates the flexibility of such sleeve anchoring approach even for the sleeves 23 and 24 of FIGS. 1 and 2.

Referring again to the bleacher assembly 46 of FIG. 4 the seats 11' may be end to end seating plank 11A and 11B assemblies with inserts 23 and 24 of FIGS. 1 and 2 or the multi-channeled seat plank extrusion 22 of FIG. 3 mounted on a flange 41' of bleacher mounts 49 at the tops of vertical supports 50, 51 and 52, etc. The plank assembly extrusion 11A and 11B assemblies of FIGS. 1 and 2 may also be used as footboards 45 mounted on horizontal frame members 53 and 54, etc. of the bleacher assembly having a base 55 resting on a supporting surface.

The curved stadium seat section 56 of FIG. 5 utilizes an extruded seating plank extrusion such as seat planks 11A and 11B of FIGS. 1 and 2 or seat plank 22 of FIG. 3 or other multichanneled seating plank extrusions. However, the seating plank extrusions 57, 57' and 57'' etc. used are formed with curves matching curvature of the seat steps 58, 59 and 60 etc. of the supporting structure in the stadium seat section 56. With this structure the inserts 61 and 62, 61' and 62', and 61'' and 62'' used are provided with matching curves respectively to the curvature of the seating extrusions where used. Inserts 61–62'' for spaced front and rear seating plank channels are much more readily formed with a seat plank matching curve and more easily inserted in place than would be the case with one large insert spanning the internal front to rear width of seating planks.

Whereas this invention is here illustrated and described with respect to several specific embodiments hereof, it should be realized that various changes may be made without departing from the essential contributions to the art made by the teachings hereof.

I claim:

1. Mass seating equipment comprising, end-to-end positioned, multi-channeled, elongate support planks with a support surface; a front channel and a rear channel in each of said elongate support planks; channel inserts sized to be snug sliding fits inserted in the respective front and rear channels; anchor means for each of said channel inserts anchoring said inserts in an insert-receiving channel of one of each end-to-end pair of said support planks; said front and rear channels being spaced apart with a further channel means included in said elongate support planks between the front and rear channels, said further channel means being partially open to the bottom; said front and rear channels of said elongate support planks being partially open to the bottom between web lips extended from channel side walls; said channel inserts being channel-shaped with two sides and an interconnecting top, and open to the bottom by an extent greater than that defined by said channel web lips, and with the bottom extremes thereof being space-separated from the end extremes of said web lips; said channel inserts being of adequate length to extend into end-to-end positioned channels of said elongate support planks, with overlap in each giving structural alignment and mutual support to end-to-end positioned ones of said support planks; and mount means for said end-to-end positioned planks, said mount means including bolt-clip assemblies and fixed mounting flanges, said bolt-clip assemblies engaging only said web lips in a clamping action to said fixed mounting flanges through both areas of channel insert overlap and outside of channel insert overlap without bolt-clip assembly interference with said channel inserts, said end-to-end positioned support planks mountable both as seat benches and as footboards; and with said end-to-end positioned planks positioned with an expansion gap between planks ends.

2. The mass seating equipment of claim 1, wherein said anchor means for each of said channel inserts is a pin element extended through channel walling of both an elongate support plank and the channel insert.

3. The mass seating equipment of claim 1, wherein said front and rear channel inserts are of substantially the same shape in transverse cross-section.

4. The mass seating equipment of claim 1, wherein said front and rear channel inserts are individually shaped to match front and rear channels of different shape in a contoured support plank extrusion mounted for seating.

5. The mass seating equipment of claim 1, wherein said end to end positioned support planks are formed with curves to match curvature of a stadium section where used; and said front and rear channel insert channels are formed with curves to match the channels where used.

* * * * *